United States Patent [19]

Minami

[11] Patent Number: 4,480,834

[45] Date of Patent: Nov. 6, 1984

[54] TOY HAVING MOMENTUM IMPARTING SURFACE

[75] Inventor: Koichi Minami, Tokyo, Japan

[73] Assignee: Tomy Kogyo Co., Inc., Japan

[21] Appl. No.: 433,031

[22] Filed: Oct. 6, 1982

[51] Int. Cl.[3] ..... A63F 7/06; A63H 11/06

[52] U.S. Cl. ..... 273/85 E; 273/128 R; 446/309; 446/355

[58] Field of Search ..... 273/85, 94, 38, 199 R, 273/128 R; 46/150, 129; 272/8 R, 8 N

[56] References Cited

U.S. PATENT DOCUMENTS

| | | | |
|---|---|---|---|
| 1,917,700 | 7/1933 | Clark | 273/85 E |
| 3,572,696 | 3/1971 | Poynter | 273/199 R X |

FOREIGN PATENT DOCUMENTS

| | | | |
|---|---|---|---|
| 524048 | 11/1953 | Belgium | 273/85 E |
| 951911 | 4/1949 | France | 273/85 E |
| 110669 | 11/1917 | United Kingdom | 273/85 E |

OTHER PUBLICATIONS

Tomy 1982 Catalog, p. 47, 8-1982, Strolling Bowling.

*Primary Examiner*—Paul E. Shapiro

*Attorney, Agent, or Firm*—K. H. Boswell; Edward D. O'Brian

[57] ABSTRACT

A toy has a base with a surface thereon. A portion of the surface is movable with respect to the remainder of the surface. A target is mounted on a pedestal above the surface. A self-propelled object is associated with the surface. The object is of the type having a body section and a pedestal section, with a motor located in the body section which is capable of moving the pedestal section with respect to the body section. The object further includes a hand-shaped member which is capable of locking with a post which projects upwardly from the surface of the base near the movable portion of the surface. A moving member is associated with the movable portion of the surface for moving that portion. The moving member is utilized to move the movable portion of the surface such that when the object is located on that portion as the portion moves then the object is also moved.

8 Claims, 6 Drawing Figures

TOY HAVING MOMENTUM IMPARTING SURFACE

BACKGROUND OF THE INVENTION

This invention is directed to a toy having a base with a surface thereon with a portion of the surface movable with respect to the remainder of the surface such that a self-propelled object moving across the surface, when located on the movable portion of the surface, can be moved off of the surface by forceful movement of the movable portion of the surface.

A group of toys are known which utilize a self-propelled object which is capable of moving in a random manner over a surface. Currently, two of these toys are on the market under the names Goof Around Golf TM and Strolling Bowling TM. A further of these toys is described in application Ser. No. 433,030 filed Oct. 6, 1982, entitled, TOY HAVING PLAYING SURFACE WITH ROTATING MEMBER THEREIN.

All of the above toys utilize an object which is shaped as a ball with a pedestal located below the object in the shape of feet. The feet are sized and shaped to be consistent with the theme of the game. The pedestal-like feet are moved with respect to the body of the object by a wind up motor located within the body of the object. The object jumps, or hops, in a motion across a surface. This motion is somewhat erratic and unpredictable. The movement of the object is very entertaining due to the erratic motion of the object.

In the Goof Around Golf TM toy, the ball object is shaped as a golf ball and is set on a course such that, hopefully, it will land into a receptacle corresponding to a hole in a golf course. In the Strolling Bowling TM toy, the ball has the motif of a bowling ball and is directed toward a set of hinged pins. The pins are aligned in the normal manner in which bowling pins are aligned, and are capable of being knocked over in the manner of bowling pins, such that strikes, spares, splits, etc. are possible. In the above referred to application, entitled, TOY HAVING PLAYING SURFACE WITH ROTATING MEMBER THEREIN, the object is directed to a rotatable platform which serves as home plate for a baseball diamond. The object is redirected by rotation of the platform.

Because of the unpredictable nature in utilizing the above identified toys, the play value is quite high. As such, the toys are interesting and stimulating to both children and adults.

A group of toys are known, such as those described in U.S. Pat. Nos. 4,219,198; 4,174,835 and 4,183,533 in which objects within the toy are directed to a target by imparting momentum to them, such that they are propelled toward the target or providing sufficient momentum to them such that they can roll up an inclined plane or the like. The objects utilized in the games described in these patents, however are not self-propelled objects, and as such, are not capable of exhibiting the random motion of the objects utilized in Goof Around Golf TM and Strolling Bowling TM and other described toys. Successful capture of the object of the toys described in these patents by the targets of the toys described in these patents is based more on the initial placement of the object and does not take into account the additional excitement created by utilizing a self-propelled, random moving object.

BRIEF DESCRIPTION OF THE INVENTION

In view of the above, it is an object of this invention to provide a toy which utilizes a self-propelled, random moving object in combination with a mechanism capable of propelling this object above a surface toward a target. It is a further object of this invention to provide such a toy which is simple in construction and thus is capable of being economically manufactured and sold, yet is of sufficient construction to ensure a long and useful lifetime.

These and other objects, as will be evident from the remainder of this specification, are achieved in a toy which comprises: a base having a surface, said surface including at least one movable portion, said movable portion movable at least upwardly from the remainder of said surface; target means mounted on said base and having a target portion thereof located above said surface; a self-propelled object associatable with said surface, said object including motor means, said object having a body section and a pedestal section, said pedestal section movably mounted to said body and moved with respect to said body section by said motor means, said object capable of moving across a support surface by moving said pedestal section with respect to said body section; moving means associated with said movable portion of said surface for moving said portion, said movable means in moving said portion capable of imparting sufficient momentum to said portion such that if said object is located on said portion as said portion is moved said momentum is transferred to said object propelling said object upwardly off of said portion of said surface toward said target portion of said target means.

Preferredly, the movable portion of the surface would be capable of imparting both a vertical and a horizontal component of force to the object in propelling the object toward the target. This can be achieved by providing the movable portion of the surface as a portion of a first lever means. The first lever means would be pivotally attached to the base and movable with respect to the base. It is further achieved by providing the movable means as a second lever means. The second lever means would also be pivotally attached to the base and would be in operative association with the first lever means and capable of forcefully pivoting the first lever means.

More than one movable portion of said surface can be provided. Each of said movable portions would comprise a first lever means which would be in operative assocation with the second lever means. Each of the first lever means would be capable of being forcefully pivoted by interaction of the second lever means with it.

In a preferred embodiment of the invention, each of the first lever means would comprise a second class lever having its respective movable portion of said surface located on one of its ends. The second lever means would comprise a first class lever having one of its ends in operative association with each of the first lever means and the other of its ends positioned on the base such that it could be operated upon by the player of the toy.

In the preferred embodiment the object could further include an engagement means and the base would include an engagable means. Engagement of the engagement means with the engagable means would cause the object as it moved on the surface to pivot about the engagable means. It is preferred that the engagable means be positioned in association with the movable portion of the surface such that as the object pivots about the engagable means, it alternately moves between the surface and the movable portion of the surface. Further, it is preferred that the engagable means be movable with respect to the surface between an operative position and a non-operative position, with the object capable of engaging the engagable means when it is in its operative position and being disengaged from the engagable means in response to the engagable means being moved from its operative to its non-operative position.

BRIEF DESCRIPTION OF THE DRAWINGS

This invention will be better understood when taken in conjunction with the drawings wherein.

Figure 1:
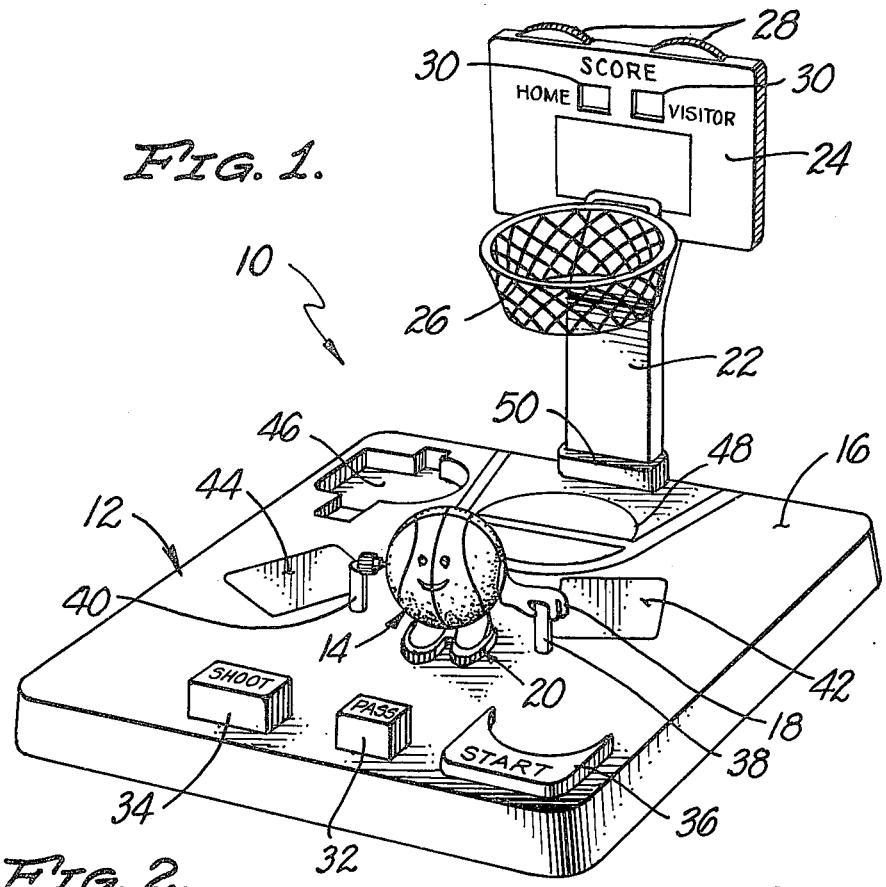
FIG. 1 is an oblique view of the toy of the invention.

The invention described in this specification utilizes certain principles and/or concepts as are set forth in the claims appended to this specification. Those skilled in the toy arts will realize that these principles and/or concepts are capable of being expressed in a variety of illustrative embodiments. For this reason, this invention is not to be construed as being limited to the exact illustrative embodiment herein, but is to be construed as being limited only with respect to the claims.

DETAILED DESCRIPTION OF THE INVENTION

The toy 10 shown in the Figs. has a base component 12 and an object component 14. The object component 14 is not attached to the base 12 but is free to move across the top surface 16 of the base 12 under its own power when activated as hereinafter described. The object 14 is designed as a characterized basketball with its left hand 18 projecting outwardly and downwardly and its feet, collectively identified by the numeral 20, serving as a support pedestal for it.

The base 12 includes an upright 22 having a scoreboard 24 and a basket 26 attached thereto. The scoreboard 24 includes dials, collectively identified by the numeral 28, located on its back side, with a portion of the dials exposed through rectangular openings, collectively identified by the numeral 30.

Projecting upwardly from the surface 16 is a pass button 32 and a shoot button 34. These are activated by pressing them downwardly into the surface 16. To the right of the pass button 32 is a upwardly projecting "U" shaped member 36, which serves as a starting gate for use of the toy as hereinafter explained. Forward and to the left of the member 36 is control post 38 which raises and lowers with respect to the surface 16 on depression of the pass button 32. To the left of the control post 38 is stationary post 40.

A first launch surface 42 is located in the center right of the surface 16 and a second launch surface 44 is located in the center left of the surface 16. Additionally, surface 16 includes a depression 46 which is used to store the object 14 therein when the toy is not being used. Further, indicia 48 is painted on surface 16 which is in keeping with the theme of the basketball type game associated with the toy 10.

The toy is used as follows. The motor, hereinafter described, in object 14 is wound, and the object 14 is placed within the "U" shaped area of the member 36 projecting upwardly from the surface 16. The object 14 is released and it moves forward under its own power in somewhat of an erratic hopping motion. If the object 14 in moving forward, contacts the control post 38, it is capable of becoming engaged on the control post 38 by having its left hand 18 hook thereon. When so hooked on to the control post 38, it will hop around in a spinning manner, orbiting the control post 38. When so attached to the control post 38, one place of its orbit places it directly over the first launch surface 42. If the shoot button 34 is now depressed, the first launch surface 42 moves upwardly and forwardly with sufficient momentum to propel the object 14 also upwardly and forwardly. If timing of the press of the shoot button with the position of the object 14 is correct, the object 14 will be propelled upwardly and toward the basket 26 and it is capable of becoming lodged therein if all events are coordinated. A score is assigned to correctly depositing the object 14 within the basket 26. This is indicated on the scoreboard 24 by rotating one of the dials 28 such that the score is exposed through the opening 30. Each of the dials 28 have a series of indicia located on the surface, different indicia being exposed upon rotation of the individual scoring wheels 28 through the individual openings 30.

If, instead of depressing the shoot button 34, when the object 14 is engaged with the control post 38, it is possible also to depress the pass button 32. This withdraws the control post 38 downwardly into the surface 16 sufficiently to release the engagement between the hand 18 and the control post 38. If this procedure is coordinated with the position of the object 14, it is capable of releasing the object 14 at such times that the object 14 will move toward the second launch surface 44. The object 14 is capable of engaging the stationary post 40 in a manner similar to that of its engagement with the control post 38. When the object 14 is engaged with the stationary post 40, it will orbit the stationary post 40 in the same manner that it did the control post 38.

As with the launch surface 42, as the object 14 orbits the stationary post 40, it becomes positioned over the launch surface 44. At this time, the shoot button 34 can also be depressed, and as before, the object 14 is propelled upwardly and forwardly by the momentum imparted to it by the second launch surface 44 also moving upwardly and forwardly. If the object 14 is successfully deposited into the basket 26, again a point score is credited to the player in control of the game 10.

The game 10 can be played by one person or two people taking alternate turns. In any event, the person or persons playing the game try to accumulate as many points as they can within certain confines of the rules of the game by depositing the object 14 in the basket 26. If two players are playing with the toy 10 simultaneously, their individual scores are kept on the two individual scoring dials 28.

As will be described below, the object 14 has a wind up motor located therein. This wind up motor is only capable of propelling the object 14 for a limited amount of time. As such, the player currently in charge of the toy 10 cannot let the object 14 orbit either the control post 38 or the stationary post 40 for too long a period of time before the motor within the toy 10 will unwind. This requires that the player then utilizing the toy 10 attempt to launch the object 14 toward the basket 26 within a very few orbits of the object 14 about either the control post 38 or the stationary post 40.

Depending upon the position of the object 14 on either the first or second launch surfaces, 42 and 44, and the particular orientation of the object 14 with respect to these surfaces, the object 14 may or may not travel toward the basket 26 such that it can be deposited in the same. In playing with the toy 10 the players are given a certain number of times they can rewind the motor within the object 14 in an attempt to see who can accumulate the most points in that period of time. Normally, the second launch surface 44 will be slightly depressed rearwardly from the basket 26 than will be the first launch surface 42. As such, it would be more difficult to score points by launching the object 14 from the second launch surface 44 than from the first launch surface 42. Thus, normally more points will be credited for successfully depositing the object 14 in the basket 26 from the launch surface 44 compared to depositing the object 14 in the basket 26 from the first launch surface 42.

Not viewable in FIG. 1 would be the fact that the dials 28 are simply attached to the score board 24 by appropriately attaching each with a screw not numbered or seen, through the rear surface of the dial to the rear of the scoreboard 24. The upright 22 is frictionally fit to the base 12 by pushing the upright 22 into the flange 50 which extends upwardly from the surface 16. During non-use of the game, the upright 22 is simply removed from the flange 50 and stored flat against the surface 16 while the object 14 is stored within the depression 46.

Figure 2:
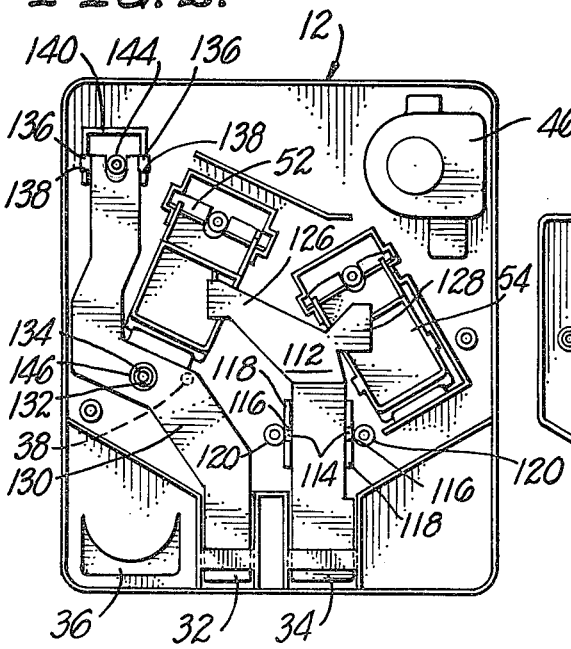
FIG. 2 is a bottom plan view of the toy seen in FIG. 1 with an overlaying plate removed to show clarity of the components located behind it.
Figure 3:
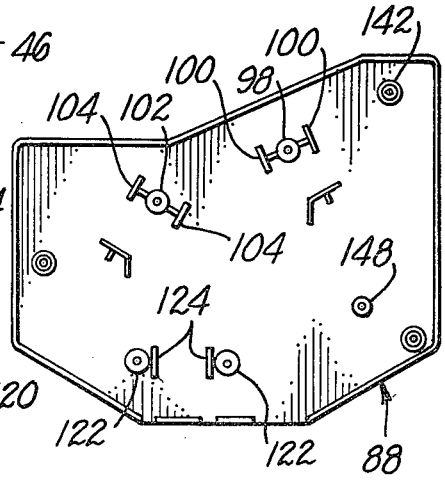
FIG. 3 is a top plan view of the plate removed in FIG. 2.
Figure 4:
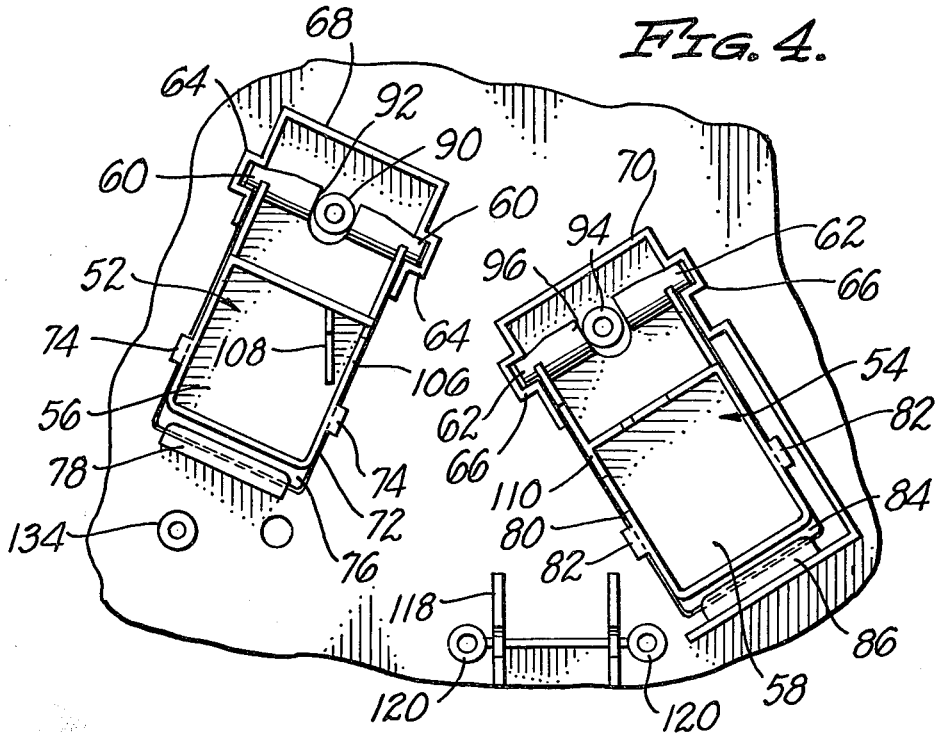
FIG. 4 is a bottom plan view of the central portion of FIG. 2 with an overlaying component removed for clarity of the parts located beneath it.

Turning now to FIGS. 2, 3 and 4, the under side of the base 12 and certain components located thereon are seen. The first launch member 52 has the launch surface 44 located on it. The second launch member 54 has the second launch surface 44 located on it. The launch surface 42 is located on the other side of the rectangular area identified by the numeral 56 on the first launch member 52. Likewise, the second launch surface 44 is located on the other side of the rectangular area identified by the numeral 58 on second launch member 54.

Both the first and second launch members 52 and 54, respectively, are second class levers which are hinged to the base 12 on the bottom side of the surface 16. The first launch member 52 includes trunnions, collectively identified by the numeral 60, projecting from its right and left side near one of its ends. The second launch member 54 includes similar trunnions, collectively identified by the numeral 62, also located on one of its ends. These fit into appropriate sockets, collectively identified by the numerals 64 and 66 for the members 52 and 54, respectively. These sockets 64 and 66 are formed by upstanding ribs 68 and 70, respectively, which are molded on to the back side of the surface 16. The first and second launch members 52 and 54, in pivoting in the sockets 64 and 66, move upwardly and downwardly with respect to the surface 16 in an arcuate manner, centered about their trunnions 60 and 62 respectively. This moves the launch surfaces 52 and 54 also in an arcuate manner such that these surfaces move upwardly in an arc which will instill a vertical and a small horizontal component of force to anything that is on the launch surfaces 42 and 44 when the launch members 52 and 54 are rapidly rotated.

First launch member 52 includes an upstanding rib 72 which is formed in essentially a square shape. Two projections off of two parallel sides of rib 72, not separately identified or numbered, project toward the trunnions 60. On the right and left hand sides of the rib 72 are two small detents, collectively identified by the numeral 74. The detents 74 keep the first launch member 52 from pivoting beyond a certain point upwardly from the surface 16. The rib 72 does not go all the way to one edge of the launch member 52, such that a lip 76 is formed thereon. The lip 76 abutts against a lip 78 formed on the underside of surface 16. When the first launch member 52 is located such that the first launch surface 42 is flush with the surface 16, it is held in this position by the lip 76 contacting the lip 78. This prevents the first launch member 52 from extending downwardly into the base 12 such that the plane of the launch surface 42 would be below the plane of the surface 16. Likewise, second launch member 54 has a rib 80 formed as a square with extensions thereon leading to the trunnions 62 and has appropriate detents 82 located on the left and right hand sides which limits the upward movement of the member 54 in the same manner as the upward movement of the member 52 was limited. Furthermore, the member 54 contains a lip 84 next to the edge of the rib 80 which interacts with a lip 86 formed on the bottom side of surface 16 to limit the downward motion of the member 54 with respect to the surface 16.

A retaining plate 88 seen in FIG. 3 fits over the bottom surface of the base 12 and retains the first and second launch members 52 and 54 in their position on the underside of the surface 16. An upstanding boss 90 is formed on the underneath side of the surface 16 and projects through a small cutout area 92 located in the first launch member 52 between its trunnions 60. Likewise, a boss 94 also formed on the underneath side of surface 16 projects between a cutout 96 formed on launch member 54 between its trunnions 62. A boss 98 is formed on the under side of retaining plate 88. It includes two satellite extensions, collectively identified by the numeral 100, projecting on either side. When the retaining plate 88 is mounted on to the bottom of the base 12, the boss 98 matches with the boss 90 with a screw passing through the boss 98 into the boss 90. This positions the projections 100 up against the individual trunnions 60 to maintain the first launch member 52 tightly against the bottom or underneath side of the surface 16. In an identical manner, a boss 102, having projections collectively identified by the numeral 104, fits up against the boss 94 and is held there by a screw with the projections 104 maintaining the trunnions 62 in their position within the socket 66.

As is viewable in FIG. 4, the rib 72 on the underside of launch member 52 contains an open area 106. A small wedge shaped rib 108 is located just inside of the open area 106 within the perimeter of the rib 72. Second launch member 54 contains an opening 110 in a different position in its square shaped rib 80. Shoot lever 112 is formed as a first class lever and is pivoted to the underneath side of surface 16 via trunnions collectively identified by the numeral 114 which fit into bearing openings collectively identified by the numeral 116 formed in ribs collectively identified by the numeral 118 and projecting downwardly from the underneath side of surface 16. Located adjacent to the ribs 118 are upstanding bosses collectively identified by the numeral 120.

The retaining plate 88 includes two bosses collectively identified by the numeral 122. Spaced inwardly from each of the bosses 122 is the rib 124. When the retaining plate 88 is placed on to the bottom of the base 12, the bosses 122 line up with the bosses 120 such that a screw can be passed through the bosses 122 into the bosses 120 and the ribs 124 bear against the trunnions 114, holding the shoot lever 112 to the bottom, or underneath side, of the surface 16.

The shoot lever 112 has the shoot button 34 located on one of its ends, with the other of its ends bifurcated, forming arm 126 and arm 128. Arm 126 passes through the opening 106 and its end contacts the rib 108 on the bottom side of launch member 52. Arm 128 passes over rib 80 on second launch member 54, through the opening 110 such that its end can contact the underside of launch member 54. Upon depression of the end of shoot lever 112 having the shoot button 34 thereon, the lever 112 pivots about its trunnions 114 and pushes up against the underside of each of the launch members 52 and 54 to rotate them about their respective trunnions 60 and 62 such that their respective launch surfaces 42 and 44 move arcuately upwardly from the surface 16.

The control post 38 is formed as a part of lever 130. Lever 130 contains an opening 132 which fits around a boss 134 formed on the underneath side of the surface 16. The lever 130 is a second class lever and it includes trunnions collectively identified by the numeral 136 on its end, which is distal from the end wherein the pass button 32 is located. The trunnions 136 fit within bearing surfaces 138 formed in rib 140. A boss 142 formed on retaining plate 88 abutts against a boss 144 formed on the under side of the surface 16. The boss 142 has a larger diameter than the boss 144 such that when the retaining plate 88 is mated against the underside of base 12, the excess diameter of the boss 142 compared to the boss 144 maintains the end of the pass lever 130 upward against the underside of the surface 16, maintaining the trunnions 136 on this lever within the bearing surfaces 138 formed on the rib 140.

A spring 146 fits within the opening 132 formed in the lever 130 about the boss 134. A small flange, not numbered or seen, is formed in the bottom of the opening 132 with a small clearance between the inside diameter of the flange and the boss 134. This allows the lever 130 to move upwardly and downwardly with respect to the boss 134. However, the flange provides a surface on which the end of the compression spring 146 abutts against. The retaining plate 88 has a boss 148 which fits within the inside of the compression spring 146 and abutts against the boss 134. When the retaining plate 88 is thus mounted to the bottom of base 12, the bosses 134 and 148 are located within the interior of the compression spring 146. The compression spring 146 pushes away from the retaining plate 88 up against the flange formed within the opening 132 of the lever 130 and biases the lever 130 upwardly against the underneath side of the surface 16. This biases the pass button 32 upwardly. When the pass button 32 is depressed, this rotates the lever 130 about its trunnions 136 which causes the control post 38 to descend to a non-operative or non-engagement position. When the pass button 32 is released, the bias produced by compressing the spring 146 pushes upwardly against the flange, pushing the lever 130 upwardly, such that the control post 38 is in an elevated or operative engagable position.

Figure 5:
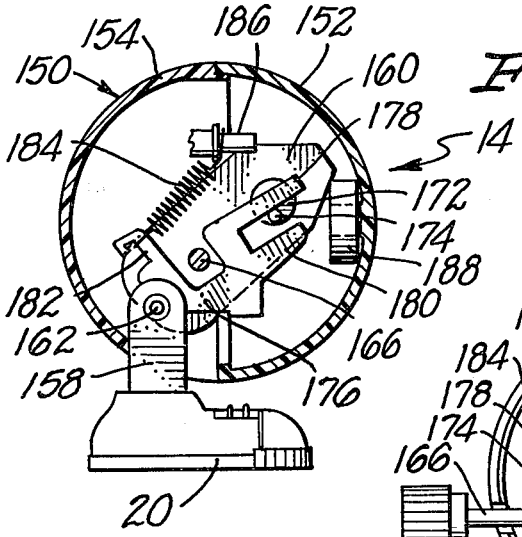
FIG. 5 is a side elevational view in partial section of the round object seen in FIG. 1, with the left side hemisphere of the outside case removed to show certain internal components.
Figure 6:
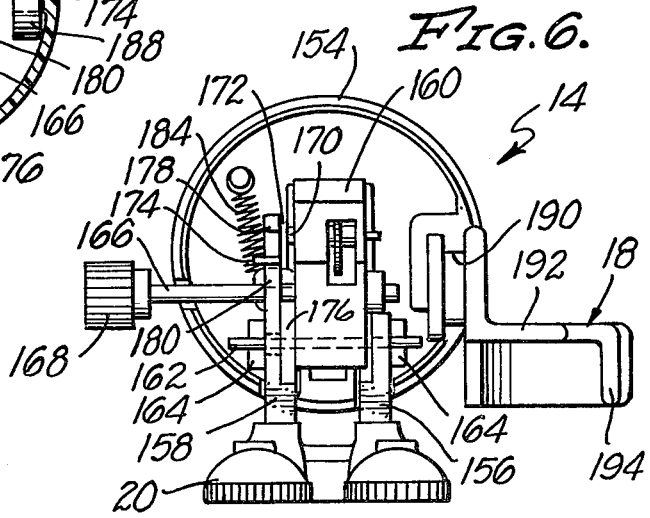
FIG. 6 is a front elevational view similar to FIG. 5 with the exception that the front hemisphere of the spherical case has been removed to show underlying components.

In reference now to FIGS. 5 and 6, the object 14 is illustrated therein. The object 14 includes a spherical shell 150. The shell 150 is formed from two hemispheres including appropriate cutouts allowing for extension of certain components from the interior. These hemispheres are formed as a front hemisphere 152 and a rear hemisphere 154. In FIG. 6, the front hemisphere 152 has been removed, leaving the rear hemisphere 154 in position. In FIG. 5, the shell 150 has been cut laterally, leaving only one half of each of the front and rear hemispheres 152 and 154 for illustrative purposes. The feet 20 of the object 14 are formed as a part of a member which includes leg uprights 156 and 158. A motor 160 is located within the interior of shell 150. An axle 162 passes through each of the leg uprights 156 and 158 as well as through a small opening, not identified or numbered, in the bottom of the motor 160. The axle 162 fits into appropriate bearing surfaces, collectively identified by the numeral 164 formed within the interior of the shell 150. This allows pivoting of the leg uprights 156 and 158 and the feet 20 attached thereto.

The motor 160 has a shaft 166 extending from it which includes a knurled knob 168 on its end. The motor 160 is energized by rotating the knurled knob 168. The knurled knob 168 is, of course, exposed outside of the shell 150 in position such that it can be appropriately rotated by the user of the toy 10. The motor 160 is a standard spring wound micromotor, which is currently found in common use in many small toys. As such, a detailed description of its operation is not necessary to the understanding of this invention.

The motor has an output shaft 170 which rotates in response to winding of the spring within the motor 160. Eccentrically attached to the output shaft 170 is a disk 172 carrying a crank pin 174 thereon. Because the disk 172 is eccentrically mounted to the shaft 170, the locus of the orbit of the crank pin 174 is larger in diameter than it would be if the disk 170 was centrically mounted on the output shaft 170.

A bifurcated lever 176 is connected to leg upright 158. The lever 176 includes arm 178 and arm 180 thereon. The crank pin 174 fits between the arms 178 and 180.

A projection 182 is located on the end of the lever 176 wherein it attaches to the leg upright 158. A spring 184 attaches at one end of the project 182 and its other end goes around a pin 186 which is formed as a part of the rear hemisphere 154 and fits into an appropriate opening in the front hemisphere 152. The spring 184 biases the lever 176 clockwise as seen in FIG. 5, such that the arms 178 and 180 tend to be biased downwardly.

A weight 188 is located on the inside surface of the front hemisphere 152 and thus biases the front hemisphere 152 downwardly.

The motor 160 is located at an inclined angle within the shell 150. This allows for orientation of the lever 176 with respect to the feet 20 as is seen in FIG. 5. The spring 184 pulling against the lever 176 rotates the lever 176 such that preferentially the crank pin 174 is lodged against the upper arm 178. When the motor 160 is energized by winding the knurled knob 168, the disk k72, as viewed in FIG. 5, is rotated counterclockwise, bringing the crank pin 174 up against the underside of the arm 178, lifting the arm 178 upwardly and at the same time stretching the spring 184. When the crank pin 174 has rotated to approximately a ten o'clock position, it clears the arm 178 and as it rotates counterclockwise toward a six o'clock position, the bias in the spring 184 rotates the lever 176 clockwise. The crank pin 174 goes across the arm 180 as the lever 176 is being rotated clockwise by the spring 184 and once again comes to rest against the arm 178 in approximately a two o'clock position. Further rotation of the disk 172 now restarts the cycle and the crank pin 174 reengages the arm 180 to move it counterclockwise to once again stretch the spring 184.

The above described movement of the lever 176 under the influence of the crank pin 174 and the spring 184, in combination with the weight 180, causes the object 14 to move across the support surface in a hopping-like manner. When the crank pin 174 clears the arm 178 at about the ten o'clock position, the force of the spring 184 in conjunction with the continued counterclockwise rotation of the crank pin 174 allows return of the lever 176 counterclockwise as seen in FIG. 5 to occur quite rapidly. This propels the object 14 upwardly in a hopping-like manner. The presence of the weight 188 keeps the front of the object 14 oriented essentially downwardly, so that the object 14 lands on the toe portion of the feet 20 in coordination with the contact of the crank pin 174 once again against the arm 178.

The left hand 18 fits into an appropriate cutout 190 formed, in part, in the front hemisphere 152 and in part in the rear hemisphere 154. The left hand 18 has a horizontal component 192 and a vertical component 194. The vertical component 194 is formed as a downwardly projecting skirt from the horizontal component 192 and the vertical component 194 is capable of engaging either the control post 38 or the stationary post 40, if the object 14 approaches these posts head-on such that the post can slip underneath the horizontal component 192 and become engaged against the vertical component 194. When the the control post 38 is lowered downwardly from the surface 16, its uppermost edge becomes vertically oriented at a lower position than the lowermost extremity of the vertical component 194, releasing the vertical component 194 from it, and thus releasing the object 14 from the control post 38.

I claim:

1. A toy which comprises:

a base having a surface, said surface including at least one movable portion, said movable portion movable at least upwardly from the remainder of said surface;

target means mounted on said base and having a target portion thereof located above said surface;

a self-propelled object associatable with said surface, said object including motor means, said object having a body section and a pedestal section, said pedestal section movably mounted to said body and moved with respect to said body section by said motor means, said object capable of moving across a support surface by moving said pedestal section with respect to said body section;

moving means associated with said movable portion of said surface for moving said portion, said moving means in moving said portion capable of imparting sufficient momentum to said portion such that if said object is located on said portion as said portion is moved said momentum is transferred to said object propelling said object upwardly off of said portion of said surface toward said target portion of said target means;

said object further includes an engagement means and said base includes an engagable means, engagement of said engagement means with said engagable means causing said object as it moves to pivot on said surface about said engagable means.

2. The toy of claim 1 wherein:

said engagable means is positioned in association with said movable portion of said surface such that as said object pivots about said engagable means said object moves alternately between said surface and said portion of said surface.

3. The toy of claim 2 wherein:

said engagable means is movable with respect to said surface between an operative position and a non-operative position, said object capable of engaging said engagable means in said operative position and disengaging from said engagable means in response to said engagable means moving from said operative to said non-operative position.

4. The toy of claim 2 wherein:

said movable portion of said surface is capable of imparting both a vertical component of force and a horizontal component of force to said object in propelling said object toward said target.

5. The toy of claim 4 wherein:

said movable portion of said surface is formed as a portion of a first lever means, said first lever means pivotably attaching to said base and movable with respect to said base.

6. The toy of claim 5 wherein:

said moving means comprises a second lever means, said second lever means pivotally attaching to said base, said second lever means in operative association with said first lever means and capable of forcefully pivoting said first lever means.

7. The toy of claim 6 wherein:

said surface having a plurality of movable portions, each of said movable portions formed as a portion of a first lever means, said second lever means in operative association with each of said first lever means and capable of forcefully pivoting each of said first lever means.

8. The toy of claim 7 wherein:

each of said first lever means comprises a second class lever having its movable portion of said surface located on one of its ends;

said second lever means comprises a first class lever having one of its ends in operative association with each of said first lever means and the other of its ends positioned on said base to be operated upon by a player of said toy.

* * * * *